United States Patent [19]

Hervieu

[11] 4,448,145

[45] May 15, 1984

[54] UNMANNED SUBMARINE VEHICLE

[75] Inventor: René Hervieu, Nantes, France

[73] Assignee: Centre National pour l'Exploitation des Oceans, Paris, France

[21] Appl. No.: 433,050

[22] Filed: Sep. 30, 1982

Related U.S. Application Data

[63] Continuation of Ser. No. 212,314, Dec. 2, 1980, abandoned, which is a continuation of Ser. No. 902,230, May 2, 1978, abandoned.

[30] Foreign Application Priority Data

May 4, 1977 [FR] France ..... 77 14154

[51] Int. Cl.[3] ..... B63G 8/00; B63G 8/14

[52] U.S. Cl. ..... 114/312; 37/56; 37/58; 37/DIG. 8; 43/4; 114/255; 114/331

[58] Field of Search ..... 114/312, 321, 330–333, 114/342, 255; 37/56, 58, DIG. 8; 43/6.5, 4.5, 4

[56] References Cited

U.S. PATENT DOCUMENTS

| | | | |
|---|---|---|---|
| 3,127,863 | 4/1964 | Tinajero | 114/333 X |
| 3,343,511 | 9/1967 | Hinton et al. | 114/330 |
| 3,415,068 | 12/1968 | Casey, Jr. et al. | 37/56 X |
| 3,812,922 | 5/1974 | Stechler | 114/331 X |
| 3,815,267 | 6/1974 | Laarman | 37/DIG. 8 X |
| 3,971,593 | 7/1976 | Porte et al. | 37/56 |
| 4,231,171 | 11/1980 | Balligand et al. | 37/56 X |

*Primary Examiner*—Sherman D. Basinger

*Attorney, Agent, or Firm*—Berman, Aisenberg & Platt

[57] ABSTRACT

An unmanned self-propelled submarine vehicle is provided with a material exchanger-container having a vertical axis of symmetry aligned with both the vehicle's center of gravity and its center of volume. The exchanger-container has a moveable diaphragm which divides the interior into two compartments, a lower ballast compartment equipped with an unloading apparatus and an upper compartment adapted to receive collected material. Ballast is unloaded during material loading to maintain the weight of the vehicle constant during loading.

14 Claims, 10 Drawing Figures

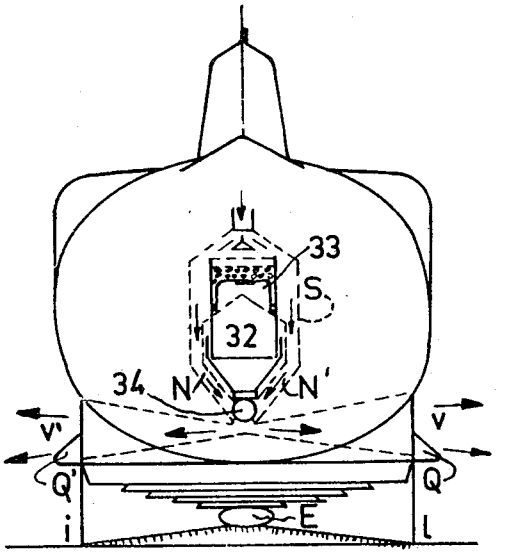
FIG.2
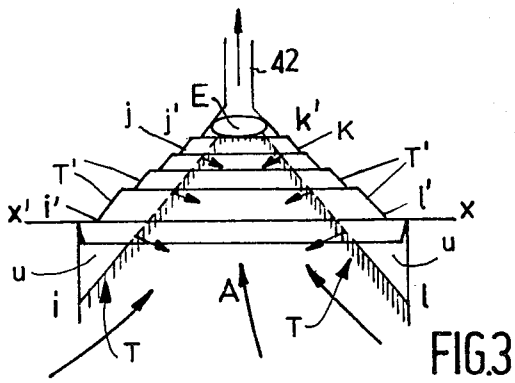
FIG.3
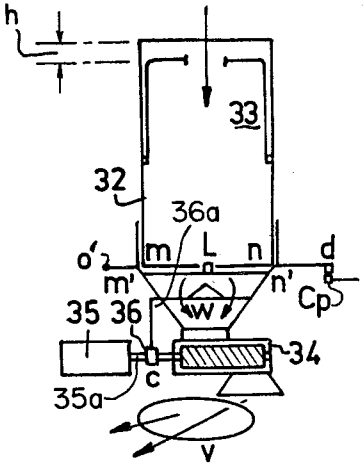
FIG.4
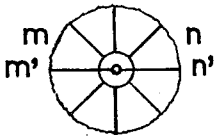
FIG.5
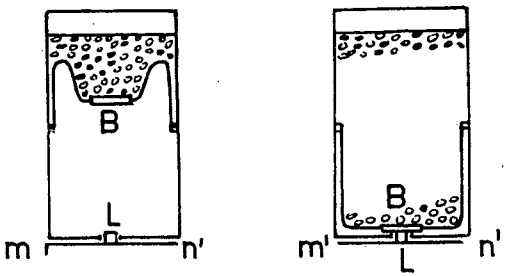
FIG.6
FIG.7
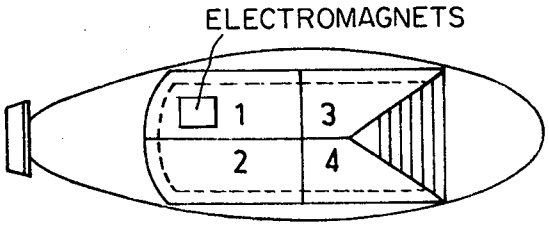
FIG.8

UNMANNED SUBMARINE VEHICLE

This is a continuation, of application Ser. No. 212,314, filed Dec. 2, 1980 now abandoned, which was a continuation of 902,230, filed May 2, 1978 now abandoned.

FIELD OF THE INVENTION

The present invention relates to an unmanned self-propelled submarine vehicle of industrial type which is designed principally on the one hand for effecting at great depth on the ocean bed such work as dredging and taking on board polymetallic nodules and raising the latter to the surface, and on the other hand for pelagic fishing and the raising of submerged bodies.

BACKGROUND

Terrestrial resources show obvious signs of exhaustion. By the end of the century man will have to turn towards the oceans to obtain a large proportion of his requirements in respect of food, energy, and mineral deposits.

The size of reserves of polymetallic nodules lying on ocean beds is out of all proportion to that of terrestrial reserves of known precious minerals.

Among processes contemplated for collecting these nodules, some have not yet got beyond the conception stage. Nevertheless, two methods of working have reached the phase of experiments at sea. One consists in gathering together the nodules on the bed and introducing them into a lifting pipe connecting the collecting machine on the ocean bed to the storage unit on the surface or submerged near the surface. The other is based on dredging by means of an immsense loop which rotates continuously and to which buckets or scoops are attached on the noria principle.

The practical application of either of these methods, based on a platform situated in the sea, encounters the difficulties due to the great depth at which the substantial deposits known as the present time are situated, this depth usually being of the order of four to six thousand meters.

The deposits which will be worked first are those which are situated on substantially flat beds, which are usually composed of viscous, sticky clay.

This nature of the ocean beds makes it difficult if not impossible to use vehicles equipped with wheels, caterpillar tracks, or sledges which have already been conceived for working at shallow depth.

SUMMARY AND OBJECTS

The aim of the present invention is to provide an unmanned self-propelled submarine vehicle which will automatically effect the dredging and loading of nodules and bring to the surface the products collected without there being any material connection between the submarine deposit worked and the storage apparatus on or near the surface. This submarine vessel can move on the ocean bed without becoming bogged. On the one hand its apparent weight is in fact as low as may be desired, whatever the size of its cargo; on the other hand, its surface of contact with the bed apart from the dredging apparatus is practically negligible.

For pelagic fishing the invention also proposes the direct catching of small fish with the same vehicle, without the use of a trawl.

In the salvage field the invention proposes to provide an apparatus for raising submerged bodies.

The shape of the submarine vehicle of the invention is distinguished from that of a conventional submarine by the presence of its bottom of flexible skirts of synthetic material which make it possible to support it above the ocean bed throughout the dredging operation. Apart from this feature, its shape takes into account the problem of resistance to propulsion and stability on the surface and during diving. On the surface the vehicle must have adequate nautical properties to be able to be towed, taking into account the oceanographical and meteorological data of the zones where it is required to operate. During diving, the moment of its straightening couple retains the same value whatever plane of inclination is selected. The distribution of masses on board the vehicle must be such that the distance between its centre of gravity and its centre of volume is as great as possible and that the straight line joining these centres coincides with the vertical axis of the so-called "exchanger container" loading device constituting one of the principal characteristics of the vehicle. It follows that the loading, overloading, or unballasting of this loading device modify only very slightly the trim and the heel of the vehicle. The hull is composed of a framework and an outer casing of reinforced resin. The selection of materials in contact with seawater takes into account the phenomena giving rise to erosion and corrosion. The buoyancy of the vehicle is obtained by means of an arrangement of buoyant materials (shown diagrammatically by hatching in FIG. 1) which also resisting the action of hydrostatic pressure at greath depth. The vehicle as a whole is composed of five sections isolated from one another and provided with seawater emptying and air vent means; these sections can easily be replaced in the event of damage to their equipments.

BRIEF DESCRIPTION OF THE DRAWINGS

The accompanying drawings illustrate by way of example without limitation one form of construction of the submarine vehicle according to the invention. In the drawings:

FIG. 2 is a cross-section of the vehicle in the so-called functional equipment section containing the "exchanger container" loading device;

FIG. 3 a view from above of a detail comprising the suction mouth for nodules, situated at the front of the vehicle;

FIGS. 4, 5, 6 and 7 are views of the so-called "exchanger container" loading device during the course of its filling;

FIG. 8 is a view from below the vehicle showing the elements supporting the vehicle on the bed;

DETAILED DESCRIPTION OF THE PREFERRED EMBODIMENTS

Figure 1:
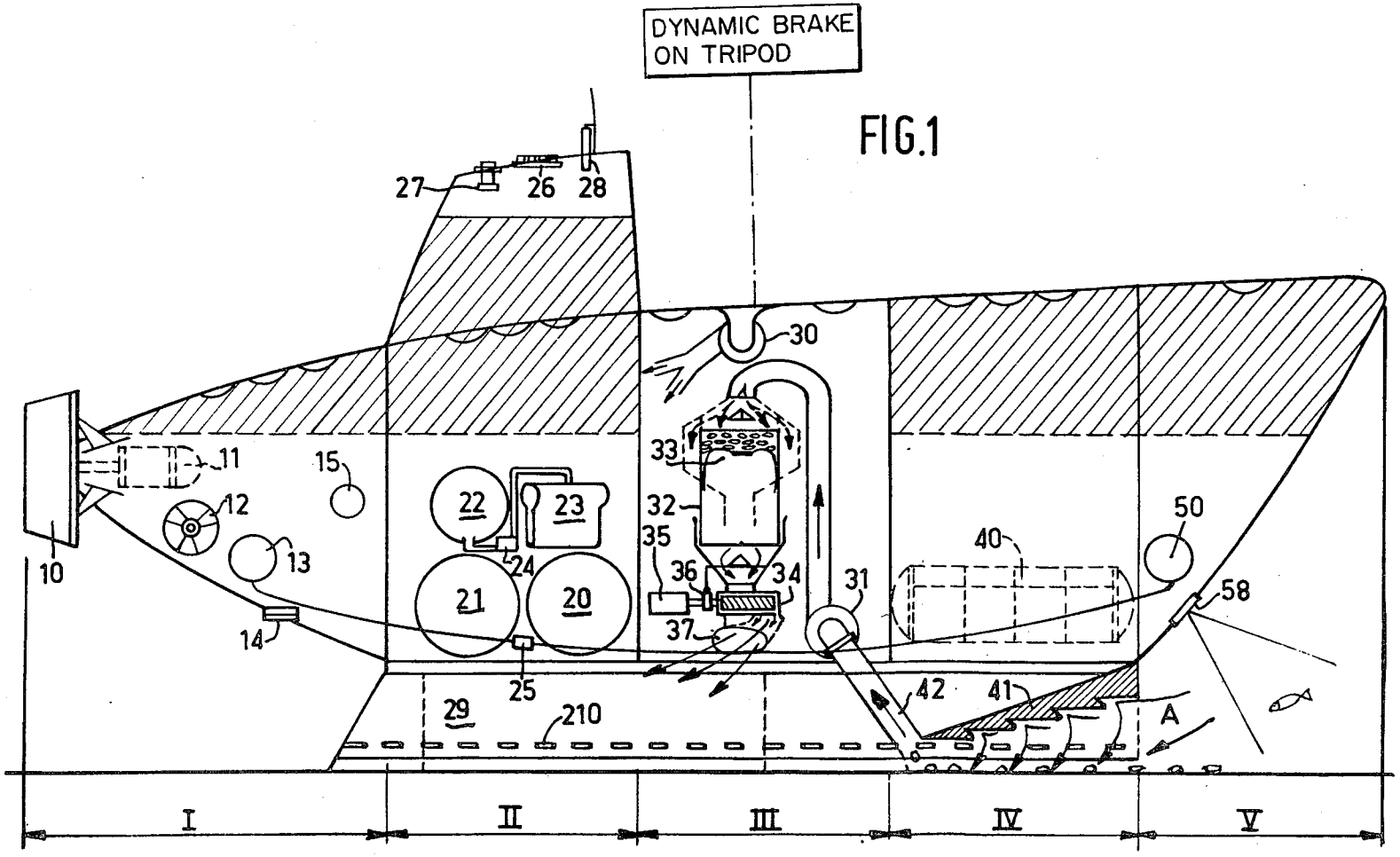
FIG. 1 is a longitudinal section of the vehicle.

As illustrated in these various figures, the vehicle is composed of the following (see FIG. 1):

I—a propulsion section;

II—a section containing the electrical and electronic equipment;

III—a so-called functional equipment section;

IV—a section containing the energy sources;

V—a front section.

Each section is separated by a watertight bulk head in a conventional manner. The equipment in each section may be removed and replaced.

The rear portion I contains a propulsion screw 10 equipped with a nozzle of the KORT type and driven by an electric motor 11, as well as a nozzle 12 having a transverse axis, the whole arrangement enabling the vehicle to be moved in all directions in a horizontal plane.

The equipment of this section is completed by a mercury type trimming tank 13, a device 14 of the DOPPLER sonar type, with a vertical axis, for sounding and determining radio speeds, and an electromagnetic log 15 intended for measuring the speed of the submarine vehicle in the vertical direction.

The section II contains at 20 a strong, fluid-tight sphere containing the electrical equipment, and at 21 a sphere of identical design which contains the electronic equipment. This section also contains a rigid metal tank 22 containing oil and in communication with a flexible tank 23 of synthetic material by means of a positive displacement pump 24 for transferring oil from 22 to 23 or vice versa. The whole arrangement (22, 23, 24) may also be replaced solely by one comprising only 22 and 24. In this case 22 contains seawater. A mercury trimming tank pump 25 is mounted on a pipe connecting the tank 13 situated in section I to another trimming tank situated in section V. The equipment of this section is completed by a mercury straightening tank pump. These two pumps are controlled by two potentiometer pendulums situated in the sphere 21, their planes of oscillation being respectively parallel to the longitudinal plane and transverse plane of the submarine vehicle. In the upper portion of the section there are situated at 26 temperature, pressure, and salinity detectors, at 27 an ultrasonic receiver and transmitter, and at 28 a radio transmitter station permitting the location of the vehicle on surfacing. This transmitter may be supplemented or replaced by an electronic flash signal light. The bottom portion of section II, III, and IV is provided with a peripheral skirt 29 of flexible synthetic material encircling a volume of liquid under slight elevated pressure in relation to the outside water, thus forming a kind of "water cushion" supporting the vehicle above the ocean bed. The skirt is equipped with a horizontal string of weights 210 causing the skirt to fall vertically into its position of utilization as soon as the operation of landing is effected a few meters from the bed at very low speed. During the descent of the vehicle these skirts are kept applied under the hull through the action of electromagnets of the said string of weights.

Section III contains a centrifugal pump 30 applying elevated pressure to the volume encircled by the skirt and constituting the cushion of water. The suction mouth is situated on the vertical line passing through the centre of gravity G and the centre of volume c of the submarine vehicle. Pumping into the cushion is effected through apertures situated in the longitudinal plane of the vehicle. This pump also serves for accelerating or braking the movement of the vehicle in the vertical direction. This section also contains a centrifugal suction and delivery pump 31 in communication with the so-called "exchanger container" loading device 32 intended for receiving the products which are to be collected, which may be either nodules or fish, and whose vertical axis coincides with the line GC of the submarine vehicle. The "exchanger container" arrangement and its accessories is fixed to the framework of the vehicle by electromagnets or any other means permitting instantaneous release in the event of the vehicle being held on the bed. Inside the cylindrical casing constituting the exchanger container the latter has a flexible diaphragm 33 of synthetic material forming a "glove finger" and capable of being turned inside out, like the latter, in order to effect a continuous separation of the product taken from the bed and the ballast in the course of the loading. The accessories of the exchanger container comprise an Archimedean screw porportioner 34 for automatic ballast discharge, driven by an electric motor 35 controlled by a differential pressure pickup. The transmission shaft connecting the motor to the proportioner carries a cam 36 operating, by means of a roller, a conical vibrator situated in the bottom portion of the exchanger container, its purpose being to prevent the formation of an arch or the compaction or funneling of the granular ballast contained under the diaphragm 33 and to ensure the regular flow of the ballast. A lateral discharge aperture 37 effects the evacuation of this ballast and the discharge of the water delivered by the pump 31.

Section IV contains the batteries 40, which are lead batteries under neutral insulating liquid in cases in pressure equilibrium with the outside medium. Other additional sources of energy, such as accumulators and batteries, are obviously provided to operate the electronic equipments. The bottom portion of this section contains the suction mouth 41 in communication with the pump 31 by way of a semirigid hose 42.

Finally, section V contains the mercury trimming tank in communication with the similar tank 13 in section I. A floodlight, for example an electronic flash floodlight, may be provided for pelagic fishing.

The electric cables are obviously of a suitable type, watertight under the conditions of pressure existing and havinr regard to their immersion in alternately hot and cold water. Transmission of data from one point to another in the submarine vehicle is where possible effected by means of optical fibres.

The exchanger container 32 composed of a straight cylinder having a circular base and made of reinforced resin is provided at its base with a grid mm having the shape shown in FIG. 5. A diaphragm 33 of synthetic material, forming a pocket, is fixed by its edge on the inner periphery of the cylinder, halfway up the latter. A large stopper (FIG. 6) forming a disc is screwed into a crown fastened to the bottom of the pocket. In the upper position shown in FIG. 4 this stopper is not situated in the top part of the cylinder but at a distance h therefrom, so as to form a certain so-called "overload" volume. The body of the exchanger container engages with clearance in a frustoconical hopper of reinforced resin, the bottom part of which leads onto the Archimedean screw proportioner 34 driven by the motor 35 by means of a shaft **35*a* carrying a cam 36, which by means of a roller and a set of rods 36*a* drives a metallic vibrating cone W ensuring the regular flow of the ballast which is then entrained in the outlet of the proportioner by the water permanently delivered by the centrifugal pump 31. The frustoconical hopper is movable about a horizontal axix o'. Its movement about that axis is limited by a lever arm o'd, which is fastened to it and whose end d rests on a differential pressure pick-up cp, which at any moment indicates the weight of the exchanger container. In its upper portion the hopper also has a central contact L. The operation of the exchanger container is preceded by the operation of loading the granular ballast. With the bag 33 in the inverted position the crown carrying the stopper is situated at the top. The stopper having been moved, the granular ballast is introduced by means of a movable hose. On completion of the operation the stopper is replaced and the body of the exchanger container is covered by a concentric cylinder S forming a cover in communication with the output of the pump 31, the bottom portion of this cover having two pipes NN' leading to the outlet of the proportioner 34 and thence to two large outside lateral apertures or windows VV' through which the ballast is discharged. A deflector device situated above the top portion of the body of the container ensures better distribution of the water and of the products delivered by the pump 31**.

The nodules are drawn in through the suction nozzle E (FIG. 3) which ends in the form of a rake i j k l of trapezoidal shape, whose teeth T are placed at the edge of small skirts u of flexible synthetic material. This rake is covered by a plate 1' j' k' l' of reinforced resin, which iscorrugated with very pronounced sawteeth T', and the steps formed by the latter direct towards the ground. In a turbulent movement, the water is drawn in at A (FIGS. 1 and 3) by the centrifugal pump 31 through the semi-rigid pipe 42. This turbulent movement detaches the modules, this detachment having already been initiated by the water under pressure which passes under the skirts between the teeth of the rake, and these nodules are then directed towards the exchanger container. The cover of the rake is movable about an axis xx' (FIG. 3), rotation about this axis enabling it to be raised (by flexing semi-rigid pipe 42) through the effect of a shock and during the descent of the vehicle. The width i-l of the rake is dependent on the dimensions of the submarine vehicle; a plurality of rake elements may be associated with one another, each of them having its own suction pipe.

At the top of the exchanger container the nodules are poured by gravity into the so-called "overload" space. Before the top level of this space is reached the pressure pick-up Cp (FIG. 4) brings into operation the electric motor driving the proportioner 34, which liberates the amount of ballast necessary to bring the weight of the exchanger container back to the fixed value. As the volume of the ballast decreases in porportion as the loading continues, the bottom of the bag carrying the disc stopper B is driven in (FIG. 6) until the cylindrical portion of the body of the container is filled. The bottom of the said bag then rests on the bars of the grid mn; the disc stopper B comes into contact with the contactor L (FIG. 7), which triggers the sequential process of raising the submarine vehicle. During this operation the ballast discharger is brought into operation and discards into the sea a part of the ballast still contained in the frustoconical portion of the exchanger container, thus reducing the apparent weight of the arrangement until it becomes negative.

The exchanger container can be discharged by removing it after dismantling the removable walls of section III of the hull, or by unscrewing the disc stopper B after removing the frustoconical bottom portion and the ballast discharging proportioner attached to it, the submarine vehicle resting for example in a dry dock by its side keels QQ' on two lines of keel blocks.

At the bottom part of the submarine vehicle are fixed the skirt elements 29 which for example form the compartments 1, 2, 3, and 4 (FIG. 8) of the volume of liquid under elevated pressure in relation to the outside water through the action of the delivery of the centrifugal pump 30 in each of its compartments, thus forming cushions of water on which the submarine vehicle rests. The water escapes permanently under the peripheral skirts, which may optionally be double. Thus, for example, for a difference in pressure between the interior and the exterior of the cushions of one hundred grams, each square meter of cushion surface will be subjected to a force of one metric ton, which will be applied per square meter from bottom to top of the assumedly plane bottom face of the hull limited to the peripheral contour of the skirt 29.

This technique of water cushions permits:

better landing of the submarine vehicle, the cushion serving as shock absorbers. As previously indicated, the skirts are unfolded only during this operation of landing at reduced speed, at a few meters from the bottom, while the electromagnets (see FIG. 8) retaining the string of weights 210 can be operated by means of a guide rope, for example;

prevention of the vehicle being driven into the ground, which has a higher or lower carrying capacity, if as the result of defective operation of the exchanger container the apparent weight of the vehicle should become too great; the formation of a considerable straightening couple on the ground. If for example the vehicle should go down by the bows, the two front cushions 3 and 4 become preponderant and give rise to a greater carrying force, while that supplied by the two rear cushions 1 and 2 becomes smaller because it is easier for water to escape under the skirts;

better take-off when the submarine vehicle rises, since it is in contact with the ocean bed only through the bottom end of the skirts. This take-off is facilitated by the increase of suction in the upward direction from the centrifugal pump 30 (FIG. 1) and through the consequent increase of the elevated pressure in the water cushions. The propulsion of the vehicle on the ocean bed, supported by the cushions of water, is affected by a stern screw 10 provided with a KORT nozzle, through the suction of water in the forward direction due to the action of the pump 31 and through the discharge of the water to the outside through side apertures or windows V and V' whose axes are directed towards the rear (FIGS. 1, 2, and 4).

The movements of the submarine vehicle in the horizontal direction is controlled by means of a gyrocompass and an automatic pilot accommodated in the sphere 21, in accordance with preprogrammed routes, for example a descent route or route along the ocean bed and an ascent route, the automatic device for steering the vehicle in the water and on the bed acting on the nozzle 12 having a transverse axis. The routes of the vehicle may also be controlled by ultrasound by means of the receiver 27, particularly when the vehicle is used for pelagic fishing.

The movements of the submarine vehicle in the vertical direction for descent and ascent are controlled in such a manner as to require the minimum energy while ensuring maximum safety. For this purpose the vehicle utilises:

a diving tank, a mercury trimming and straightening tanks.

At medium depth a positive displacement pump 24 makes it possible for oil to be transferred from a rigid spherical tank 22 into a flexible tank 23 of synthetic material, or vice versa, so as to vary the total volume of the vehicle subjected to Archimedean buoyancy, without any modification of weight. This device may be replaced by a spherical metal tank into which water is introduced or from which water is withdrawn with the aid of a pump for the purpose of modifying the weight of the vehicle.

At great depth the Archimedean screw proportioner of the ballast discharger 34 of the exchanger container and also the centrifugal pump 30 are used.

Control and automatic operation are effected by a micro-computer which receives data supplied by:

an electromagnetic log 15 measuring the speed of the submarine vehicle in the vertical direction;

temperature, pressure, and salinity detectors 26;

a DOPPLER sonar 14.

The immersion value may be controlled by ultrasound in the special case where the vehicle is used for fishing. The landing and take-off of the vehicle are effected automatically in accordance with sequential processes; thus, at the end of a determined stay on the bed the ascent operation is triggered whatever the state of loading of the exchanger container.

The invention is not limited to the embodiment and utilization specifically described, but permits all possible variants provided that they are not in contradiction with the object of each of the claims accompanying the present description.

Figure 9:
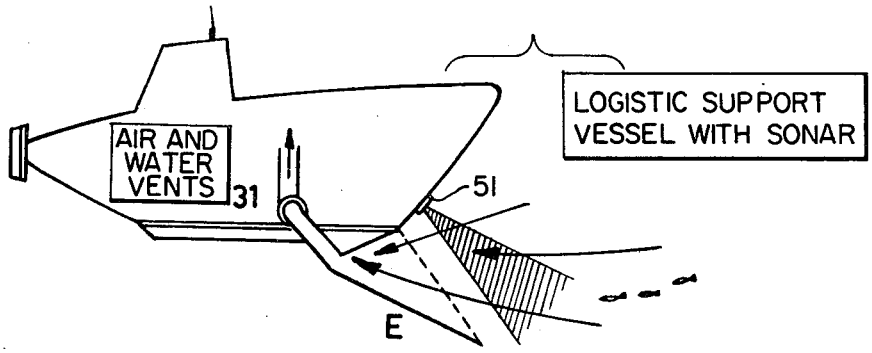
FIG. 9 is a longitudinal view of the vehicle in a version for use in pelagic fishing.

Thus, the vehicle may be used for the pelagic fishing of small fish. It is then remotely controlled in respect of submersion and steering by ultrasound with the aid of the receiver 27 from a logistical support vessel (FIG. 9) which follows the movements of fish by sonar; in order to achieve better ultrasonic communication this ship must maintain position as closely as possible to vertical alignment with the submarine vehicle, which may optionally be equipped with an acoustic pursuit system. The suction nozzle previously described may be replaced by a kind of large funnel E of flexible synthetic material (FIG. 9) which is folded up during the descent of the vehicle. Fish attracted by the floodlight 51 are drawn in by the pump 31 and poured into the exchanger container; a net surrounding the top of the latter retains the fish in the container.

Another alternative use of the submarine vehicle may be contemplated for raising to the surface submerged bodies whose apparent weight is as a maximum theoretically equal to that of the grandular ballast contained in the exchanger container whose vertical axis, as previously indicated, is situated on the line from the centre of gravity to the centre of volume of the submarine vehicle.

Figure 10:
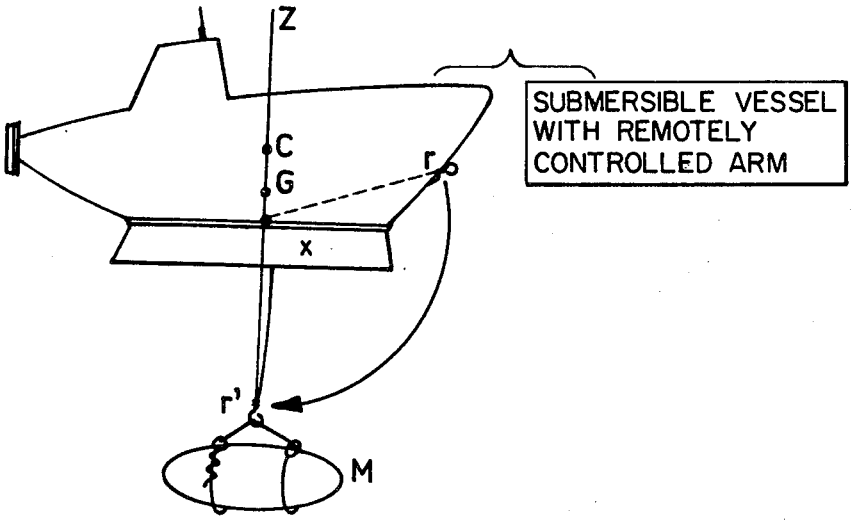
FIG. 10 is a diagrammatical longitudinal view of the vehicle in a version for use in raising submerged bodies.

The transverse plane passing through this line intersects the lateral keels along cross-sections of the latter which determine the points of attachment t and u (FIG. 10) of the ends of a chain carrying at its centre a raising hook which outside periods of use is held at r at the front of the vehicle; during the operation of raising a body M the detached hook is situated at r'. The hook may be operated with the aid of a remotely controlled arm of a manned submersible vessel capable of operating at great depth. The operation of the Archimedean screw proportioner of the ballast discharger of the exchanger container makes it possible to produce a lifting force of increasing intensity until the submerged body is detached from the bed. The proportioner is for example controlled by ultrasound from the manned submersible.

The use of hydraulic motors and, as main source of energy of nickel-cadmium accumulators, etc., may also be contemplated.

Similarly, in order to slow down the speed of descent of the submarine vehicle it would be possible to use a dynamic brake fixed on a tripod support above the suction mouth of the pump 30; starting from a given speed the blades of the said dynamic brake would open out under the action of the flow of water.

The submarine vehicle of the invention may be used for any operations which have to be carried out on ocean beds at any depth.

Particular applications may comprise the working of submarine mineral deposits, pelagic fishing, and the salvaging of submerged objects.

I claim:

1. A submarine vehicle capable of operating at extremely great depths and of gathering materials from the ocean, comprising:

(a) loading means for said materials including an exchanger-container having a vertical axis of symmetry coinciding with a line passing through the center of gravity and center of volume of said vehicle;

(b) said exchanger-container having a moveable wall, dividing the interior thereof into a first compartment containing ballast and means for unloading the ballast, and a second compartment for receiving said materials; and (c) wherein said ballast unloading means is adapted to operate to unload ballast while materials are being received in said second compartment, whereby the apparent weight of the vehicle is maintained approximately constant during a material loading operation.

2. A vehicle according to claim 1 wherein said moveable wall comprises a horizontally disposed moveable diaphragm fixed by an edge to said exchanger-container approximately midway along the height of the container, said diaphragm being provided at its center with a closeable opening.

3. A submarine vehicle as set forth in claim 1 characteristed in that it is composed of a plurality of separate sections, each of said sections being equipped with means to transmit water and means to transmit air, said sections containing means for propulsion and ground support, electrical and electronic equipment for control, detection, and guidance, and sources of energy, one of said sections containing said exchanger-container.

4. A vehicle according to claim 3, wherein a bottom portion comprises a peripheral skirt of flexible synthetic material surrounding a volume of liquid under slightly elevated pressure in relation to the outside water, thus forming a cushion of water supporting the vehicle above the ocean bed and enabling it to move thereover without the risk of becoming bogged, the said volume of water thus contained inside the skirt being divided by means of median partitions so as to form under the bow and the stern of the vehicle two front and two rear cushions which on variation of the elevated pressure of one group of cushions in relation to the other give rise to a considerable strengthening couple for the purpose of correcting a poor trim of the vehicle.

5. A vehicle according to claim 4, characterized in that the elevated pressure maintained in the skirt enclosure is obtained by the discharge of a centrifugal pump whose suction mouth is situated on the vertical line passing through the center of gravity G and the center of volume C of the vehicle, discharge being made into the cushion of water through apertures situated in the longitudinal plane of the vehicle inside the skirt, and said pump making it possible to accelerate and brake the movements of the vehicle in the vertical direction.

6. A vehicle according to claim 4 or claim 3, characterized in that the peripheral skirt is equipped with a horizontal string of weights causing the skirt to fall vertically into the position of use when the operation of landing is carried out a few meters from the ocean bed at very low speed, wherein the skirt is held against the hull, during the descent, by electromagnets on the hull.

7. A vehicle according to claim 5, characterized in that it is provided with a dynamic brake fixed above the suction mouth of the centrifugal pump feeding the cushion of water supporting the vehicle and which is activated to reduce the speed of descent of the vehicle.

8. A vehicle according to claim 1 or 2 characterized in that said exchanger-container is in communication at the top, through a concentric cylindrical cover, with the delivery side of a centrifugal pump which applies suction at the front of the vehicle through a semirigid hose connecting the pump to a suction mouth ending in a rake of trapezoidal shape whose teeth are situated on the edge of small skirts of flexible synthetic material and which is covered by a plate of reinforced resin adapted to move about a horizontal axis, the said plate being corrugated to form very pronounced sawteeth forming steps directing towards the ocean bed, whereby water drawn in by the pump effects the detachment of nodules.

9. A vehicle according to claim 8, characterized in that the bottom part of said exchanger-container fits into a frustoconical hopper of reinforced resin whose base discharges into an Archimedean screw proportioner operated by an electric motor controlled by a differential pressure pick-up and discharging into a lateral discharge aperture evacuating the ballast and discharging the water from said centrifugal pump.

10. A vehicle according to claim 9, characterized in that said hopper is movable about a horizontal axis, its movements being limited by an arm which is fastened to it and the end of which rests on said differential pressure pick-up indicating at any moment the weight of the exchanger container and triggering the operation of a proportioner drive motor in order to liberate the amount of ballast necessary to bring the weight of the exchanger container back to the fixed value.

11. A vehicle according to claim 9, characterized in that the top part of said frustoconical hopper is provided with a grid the centre of which is equipped with a contactor which through contact with a stopper of the diaphragm, which has been completely turned inside out by completion of loading with the collected product, triggers a sequential process of raising the vehicle.

12. A vehicle according to claim 1 or 2, or claim 3, which is adapted for the pelagic fishing of small fish, further comprising means for remotely controlling submersion and steering by ultrasound from a logistic support vessel which by sonar follows the movement of the fish, wherein a pump for loading the exchanger-container is connected to a funnel of flexible synthetic material through which fish which are attracted by a floodlight at the front of the vehicle are drawn and driven into the exchanger-container.

13. A vehicle according to claims 1, 2 or 3 further comprising a logistic support vessel which follows the movements of fish and guides the motion of the vehicle, and wherein a pump for loading the exchanger-container is connected to funnel means through which fish attracted by a floodlight placed at the front of the vehicle are drawn and are driven into the exchanger-container.

14. A vehicle according to claims 2 or 3 adapted to raise to the surface submerged bodies comprising a lifting hook carried by a chain each end of which is attached to a respective side of the vehicle at points in a transverse plane which passes through a line between the center of gravity and the center of volume of the vehicle, the said hook being adapted to be operated by means of a remotely controlled arm.

* * * * *